US007982164B2

(12) United States Patent
López et al.

(10) Patent No.: US 7,982,164 B2
(45) Date of Patent: Jul. 19, 2011

(54) WATER HEATER WITH IONIZED IGNITION AND ELECTRONIC CONTROL OF TEMPERATURE

(75) Inventors: Moisés Alejandro Aviña López, Estado de México (MX); Alejandro Sánchez González, Estado de México (MX); Héctor Abraham Cisneros Escalante, Estado de México (MX)

(73) Assignee: Calentadores de America, S.A: de C.V., Mexico City, C.P. (MX)

( * ) Notice: Subject to any disclaimer, the term of this patent is extended or adjusted under 35 U.S.C. 154(b) by 655 days.

(21) Appl. No.: 12/129,031

(22) Filed: May 29, 2008

(65) Prior Publication Data

US 2009/0120381 A1 May 14, 2009

(30) Foreign Application Priority Data

Nov. 9, 2007 (MX) ..... MX/A/2007/014037

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/260, 261, 262, 263, 264, 265, 266, 267, 219/268, 269; 392/441–464
See application file for complete search history.

(56) References Cited

U.S. PATENT DOCUMENTS 3,574,501 A * 4/1971 Mitts ..... 431/254
3,621,197 A * 11/1971 Place ..... 392/449
4,564,003 A 1/1986 Iwanicki et al.
4,571,863 A * 2/1986 Freckleton et al. ..... 38/86
4,681,154 A 7/1987 Yano et al.
4,925,386 A * 5/1990 Donnelly et al. ..... 431/28
5,900,176 A 5/1999 Tassicker et al.
7,163,619 B2 1/2007 Wang
2009/0302022 A1 * 12/2009 Wilcox et al. ..... 219/264

FOREIGN PATENT DOCUMENTS

CA 2 613 129 1/2007
DE 44 43 715 A1 6/1996
WO WO 98/04874 2/1998
WO WO 2004/038305 A1 5/2004
WO WO 2005/026627 A1 3/2005
WO WO 2005/040695 A1 5/2005
WO WO 2005/061969 A1 7/2005
WO WO 2007/053859 A2 5/2007
WO WO 2007/057864 A1 5/2007
WO WO 2007/101899 A1 9/2007

* cited by examiner

*Primary Examiner* — Daniel Robinson
(74) *Attorney, Agent, or Firm* — Dority & Manning, P.A.

(57) ABSTRACT

A water heater with an ionized ignition system includes an electronic controller in operative communication with a burner electrovalve, temperature detector, flow detector, and first and second spark plugs. The electronic controller is configured to ignite the water heater burner when a temperature detected by the temperature detector is less than (by preset margin) a desired water temperature input to the electronic controller by a user, and a). upon a flow demand signal from said flow detector, b). according to a time schedule input to said electronic controller; or c). when a remote control is actuated by the user.

6 Claims, 2 Drawing Sheets

WATER HEATER WITH IONIZED IGNITION AND ELECTRONIC CONTROL OF TEMPERATURE

FIELD OF THE INVENTION

The present invention refers generally to water heating equipment with an ionized system that provides a constant water supply. The water heater of the present invention is a versatile piece of equipment that can be used both in pipe equipment and in fin equipment.

BACKGROUND OF THE INVENTION

To meet the constant demand for hot water with the maximum possible fuel economy, an electronic system was integrated with a set of gas valves that gradually lights the water heater burner in a direct way by means of an electric spark, and a flame detector, like the one cited in PCT patent application WO/2007/057864. However, the water heater described in the aforementioned patent does not adapt itself fully to most conventional hydraulic installations, and therefore in many cases it is necessary to adapt or integrate other elements for its operation, increasing the equipment and maintenance cost of the entire system.

SUMMARY OF THE INVENTION

Objects and advantages of the invention are set forth in part in the following description, or may be obvious from the description, or may be learned through practice of the invention.

The water heating system of the present invention has an ignition system of the ionized type such as the one described in Patent No. WO/2007/057864, with the difference that the system of the present invention only works when the electronic card (controller) gives the order to ignite under the following conditions:

a) When the low pressure flow detector indicates a water demand to the system and the bimetallic detector, located, for example, 5.08 cm (2 inches) below the top lid of the heater, detects a temperature 4° C. lower than the temperature programmed onto the card by the user, and to turn off when it detects a temperature higher than the programmed temperature, eliminating the flow or water pressure detector which limits the equipment to having a minimal pressure in the residential hydraulic system.

b) It will also ignite when the day and hour programming in the card is actuated and when the bimetallic detector is 4° C. below the temperature programmed onto the electronic card by the user.

c) Similarly, the water heater will ignite when the wired remote control is actuated and when the bimetallic detector is 4° C. below the temperature programmed onto the electronic card.

In this way the water heater will only ignite when hot water is needed, according to the instructions programmed onto the electronic card by the user, which works with a power source that operates with, for example, four alkaline batteries of 1.5 V, lasting for a minimum for eight months.

Because on occasion the pressure of the water flow is not constant in residential hydraulic installations which are not regulated, there is need for a water heater, such as the one described in the previous paragraph, which uses any type of gas fuel, to achieve greater fuel economy, that is appropriate for the various diverse hydraulic installations already existing or which could be built in the future, to satisfy a constant demand for water at a comfortable temperature.

In a particular embodiment, the water heater of the present invention has been designed in such a way that it has a power input between 10 kW and 40 kW, and a plurality of steel tubes forming a heat transfer collector where the length and diameter of the tubes are specified according to the hot water needs of the user, with the capacity to transfer from 82% to 90% of the input power (heater efficiency) using a corrugated coil with a set of fins that delays the gas outflow and allows for maximum utilization of the energy generated by the burner, at a temperature no greater than 250° C. The entire set of components of the present invention allows the backup heater to operate without a permanently lit pilot light.

DETAILED DESCRIPTION OF THE INVENTION

Figure 1:
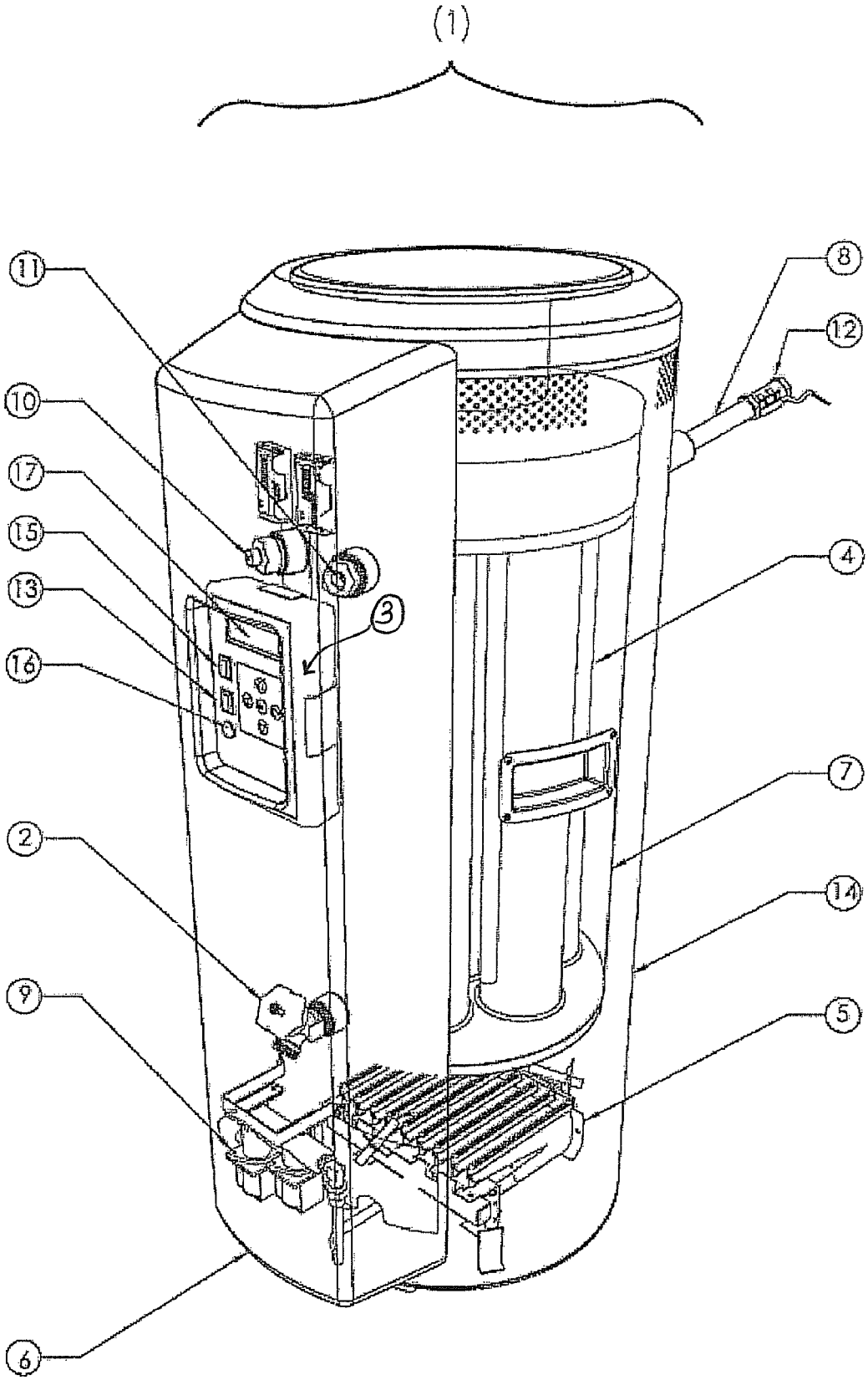
FIG. 1 is a general view of the heater of the present invention, showing its main components which are: set of electrovalves, drainage stopcock, electronic card, heat exchanger tubes, burner, and plastic or metallic cover.
Figure 2:
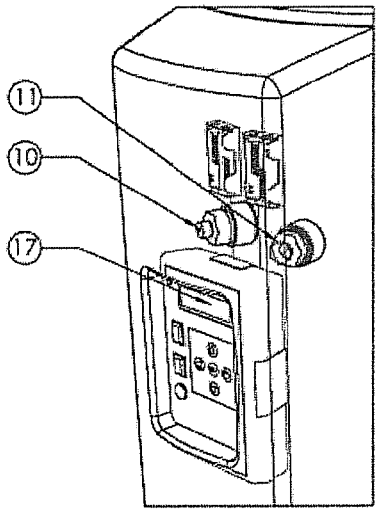
FIG. 2 is a partial view of the top part of the heater.
Figure 3:
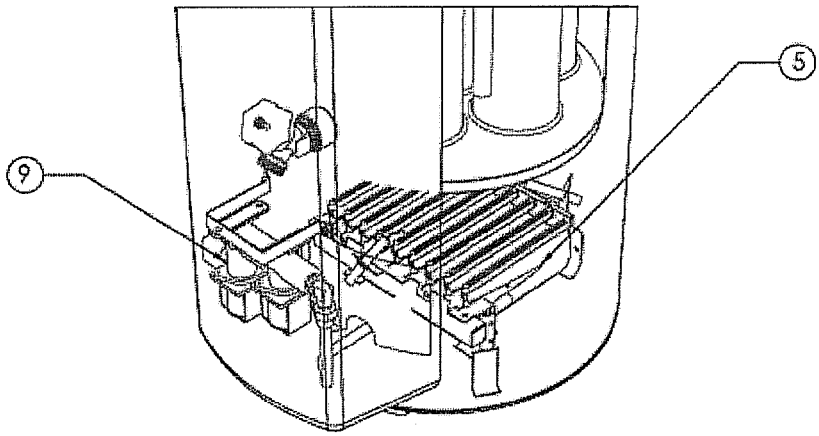
FIG. 3 is a partial view of the lower part of the heater.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The heater (1) of the present invention is designed to have only between 15 $dm^3$ (15 liters) and 40 $dm^3$ (40 liters) of internal volume and to withstand a pressure greater than 0.45 MPa. The entire tank (7) is made of steel and the areas in contact with water are porcelainized, depending on the capacity and the needs of the user.

The water feed is located at the posterior and lower part of tank (7); likewise, the water outlet is located at the upper lateral part of the tank. Additionally, on the lower part of the tank there is a coupling which connects the exterior with the water contained in the tank (7) to place a stopcock or plug (2) allowing for drainage and cleaning of the tank (7).

Power must be supplied to the water heater by means of a burner (5) with, for example, nine multi-burners (5) and with a variable nozzle diameter to supply between 10 kW and 40 kW for different types of gases.

Fuel gas is supplied by means of a system of electrovalves (9), connected to a cast aluminum or ZAMAC alloy body. This set of valves (9) connected to the cast body comprises the gas feed valve system, and said valve system is located inside a plastic cover that protects the gas feed valve system (usually, the plastic cover thickness ranges between 1.5 and 3.5 mm), the connections to the bimetallic cables (10) and the electronic card controller (3) from the atmosphere. The gas feed valves (9) are connected to the burner (5) by means of an aluminum or copper tube of 9.525 mm (0.375 inches) in diameter and brass or bronze connections of 15.875 mm (0.625 inches) in diameter which normally must be closed until the electronic card (3) gives the signal to open. The gas feed connection to the gas feed valve (9) is 1.27 cm (0.5 inches) in diameter and must be calibrated between 1.7 kPa and 3.2 kPa depending on the type of gas to be used.

The bimetallic cable temperature detector (10) is connected to a connection of brass, bronze, tropicalized steel or other corrosion resistant material in such a way that it is introduced into the connection and a neoprene seal is added to prevent water leakages.

The end of detector 10 that is in contact with the water must be tied between themselves, in order to detect the temperatures for turning on and off the ignition of the burner (5), and the opposite end is connected to the electronic card (3) as well as to the gas feed valve(9). The bimetallic cable (10) connection must be hidden by the metallic or plastic cover and located, for example, 5.08 cm (2 inches) below the top lid of the tank (7) to prevent overheating in the hydraulic network. Next to the bimetallic cable (10), another connection will be added that contains another bimetallic cable (11) for safety, the second cable only acting as a safety system in case there is overheating in the system. The heater (1) will only restart when the temperature detected by the bimetallic cable (10) is, for example, 4° C. lower than the temperature defined by the user.

The electronic card (3), upon receiving a water demand signal sent by the flow detector (12) checks the temperature, and if this temperature is 4° C. lower than the temperature programmed by the user, the card sends a direct current electric spark through a ceramic spark plug connected to the electronic card (3) by means of a cable covered with silicone and to an extension of reinforced cable to turn on the system.

The spark plug is attached, at a distance not greater than, for example, 4 mm, onto one of the multi-burners comprising the burner (5) of the water heater (1). After 1.0 second and with the electrical spark in operation, the electronic card (3) sends a signal to the gas feed valve (9) for the gradual and successive opening of the electrovalves (9) to allow for the gradual flow of gas to the burner (5), thus avoiding any excessive gas accumulation in the combustion chamber and preventing possible accidents. Once the burner (5) is lit, another spark plug attached at a distance not greater than, for example, 20 mm onto one of the multi-burners (5) detects the flame by means of an ionization process in which the spark generated by the other spark plug changes from direct current to alternating current. This current change is sent to the electronic card (3) by means of a reinforced cable and is followed by a silicone covered cable. If the change-of-current signal is not detected by the card (3) within, for example, five seconds or the signal appears intermittently in the same period of time, or if the burner goes out or the change-of-current signal appears intermittently while the heater (1) is operating, the electronic card (3) sends a signal to the gas feed valve (9) for the immediate closing of the electrovalves (9) for, for example, 10 to 15 seconds to carry out an electronic review of the components connected to card (3).

Once the aforementioned period of 10 to 15 seconds has elapsed, another attempt is made to turn on the heater (1) until a clear signal of the current change in burner (5) is obtained; if no change-of-current signal is detected after three attempts, the card (3) will show an error by means of a visual signal shown as a red light on the screen, which will indicate that, as a precaution, the system has been temporarily blocked.

Once the change-of-current signal is detected by the electronic card (3), the water inside the tank (7) will be heated until the bimetallic cable (10) sends a signal to the electronic card (3) indicating that the temperature has reached the temperature programmed by the user for the water contained inside tank (7). When the card (3) translates the signal sent by the bimetallic cable (10), which indicates that the programmed temperature has been reached, or when the flow detector (12) sends a signal to the electronic card (3) that the water demand has ended, the electronic card (3) in turn sends a signal to close the electrovalves (9) of the gas feed valve.

The ignition cycle will not be reactivated until there is again demand for water and the bimetallic cable (10) sends a signal indicating that the water temperature in the tank (7) is, for example, 4° C. lower than the temperature programmed by the user.

The electronic card (3) is electrically fed by a power source which may comprise a set of four alkaline batteries of 1.5 V, or by a set of four rechargeable batteries in turn connected to the 110/220 VAC, with an output of 6 VDC. In turn, the electronic card (3) distributes the electricity feed to the different components to which it is connected, administering it in the most efficient way to obtain a useful life for the batteries of approximately eight months according to the usage of the heater, these batteries acting only as backup since the equipment is connected to the electrical installation.

Between the power source and the electronic card (3) there are two ON/OFF switches (13), the first energizing or de-energizing the electronic system when it is working with batteries, giving priority to the 110 V electric connection, and the second to be used with alkaline or rechargeable batteries. The card (3) has two visual indicators, a blue one indicating that the heater (1) is in operation, and a red one that indicates on the screen that the heater (1) is in error or conducting a failure analysis.

The tank (7) is supported upon a combustion chamber of, for example, 26 cm (10¼ inches) in height and of a diameter less than the external diameter of the tank, but strong enough to withstand the weight of the heater when full of water. Inside the combustion chamber are located the burner (5) and the spark plugs attached to it and connected to the electronic card (3). The combustion chamber is attached to a round base which has a series of openings to provide the air flow necessary for combustion to take place and said openings are 40 mm high to allow for the airflow to circulate toward the burner (5). The combustion chamber is insulated with ceramic fiber of, for example, 5.08 to 7.62 cm (2 to 3 inches) in thickness and only the burner gate is left free of lining to have access to the chamber when it is necessary to conduct maintenance. The rest of the tank (7) is insulated with thermal fiberglass from, for example, 5.08 cm to 7.62 cm (2 to 3 inches) in thickness.

The insulated tank (7) and combustion chamber are placed inside of an external body comprising a laminate (14), which is coated with corrosion resistant electrostatic paint. This external body (14) is attached to the base of the combustion chamber and covered with a laminate lid. As was the case with the external body (14), the lid and the external base must be protected with corrosion and temperature resistant electrostatic paint. The external body (14) has three openings of different sizes, the largest one, located near the burner (5), provides an exit for the spark plug cables, as well as the tube connecting the system of gas feed valves to the burner (5) and allows for the unobstructed maintenance of the burner (5). This opening is later covered with a lid on which ceramic fiber insulation is deposited with a thickness from 5.08 to 7.62 cm (2 to 3 inches), allowing the spark plug cables and the gas feeding tube to pass through. This lid is attached by means of screws to have an easy access to burner (5) when maintaining water heater (1). The lid must be covered with corrosion and temperature resistant electrostatic paint.

The two smallest openings located in the posterior front part of the external body (14) allow the bimetallic cable (10) and the connection to pass through. Also, the gas feeding valve (9) and the electronic card (3) are attached to the posterior part of external body (14), together with the power source where the batteries are located. This set is covered with a plastic cover covered with a corrosion resistant electrostatic paint leaving visible the indicators on the information screen (17) of card (3) as well as the equipment ignition button (17).

On the other hand, the information screen (17) contains a series of buttons with which the user will be able to make the different programmings earlier mentioned.

The last opening is located on the anterior part of the external body (14) at the level of the drainage coupling where a drainage stopcock (2) is placed for tank (7) maintenance.

Figure 4:
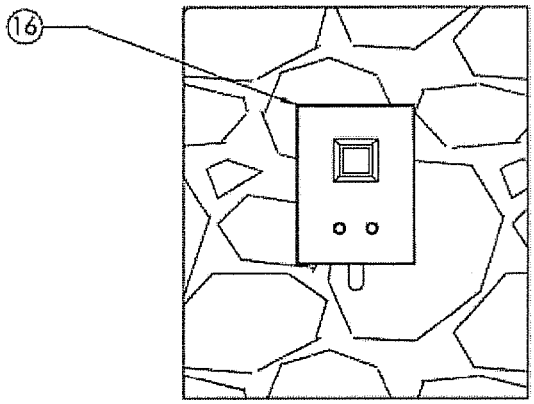
FIG. 4 is a view of the wired or wireless remote control installed in a bathroom.

The water heater (1) thus described is connected to the hydraulic installation through which the hot water flows in 1.90 cm (0.75 inches) corrosion resistant metal pipes. Water heater (1) will ignite only when the electronic card (3) gives the ignition order under the following conditions:

a) When the low pressure flow detector (12) indicates a water demand to the system and the bimetallic detector (10), located 5.08 cm (2 inches) below the top lid of the heater, detects a temperature 4° C. lower than the temperature programmed onto the card by the user, and to turn off when it detects a temperature higher than the programmed temperature, thus eliminating the flow detector or water pressure detector and limiting the equipment to a minimal pressure in the residential hydraulic system.

b) It will also ignite when the day and hour programming on the card (3) is actuated and when the bimetallic detector (10) is 4° C. below the temperature programmed onto electronic card (3) by the user.

c) Similarly, the water heater (1) will ignite when the wired or wireless remote control (16), which may be installed in the bathroom as shown in FIG. 4, is actuated as soon as the bimetallic cable (10) measures 4° C. below the temperature programmed onto the electronic card (3) by the user.

In this way, water heater (1) will only ignite when hot water is needed, under the instructions programmed by the user onto the electronic card (3), which will operate with a power source of four 1.5 V alkaline batteries or rechargeable batteries (and/or a connection to the 110/220 VAC electric grid) lasting for a minimum of, for example, eight months, and when there is a demand for water and the bimetallic cable (10) detects a temperature, for example, 4° C. lower than the temperature programmed by the user, and it will turn off when the programmed temperature is reached or when the flow detector (12) indicates that there is no longer a demand for water.

It will also ignite when the day and hour programming is activated, turning on the heater (1) on the desired days and at the time programmed by the user, and it will turn off when the bimetallic cable (10) detects a temperature higher than the temperature programmed by the user.

It should be readily appreciated by those skilled in the art that various modifications and variations can be made to the embodiments of the method and systems described herein. It is intended that the present invention encompass such modifications and variations as come within the scope of the appended claims and their equivalents.

The invention claimed is:

1. A water heater with an ionized ignition system, comprising:

a corrosion resistant tank having a plurality of heat exchanger tubes therein;

a variable nozzle burner, and a gas feed valve system including at least one electrovalve connected to a cast body configured to deliver a gas to said burner;

a bimetallic temperature detector disposed to detect water temperature within said tank;

a flow detector activated by water flow from said tank;

a remote control device;

a first spark plug positioned to ignite said burner, and a second spark plug positioned to detect current changes generated by ionization effect caused by the flame after said burner is ignited;

an electronic controller in operative communication with said electrovalve, said temperature detector, said flow detector, said remote control device, and said first and second spark plugs, said electronic controller including a temperature setting device for a user to set a desired water temperature, said electronic controller configured to ignite said burner under the following conditions:

a). upon a flow demand signal from said flow detector and a temperature detected by said temperature detector that is less than (by preset margin) a desired water temperature input to said electronic controller by a user;

b). according to a time schedule input to said electronic controller when the temperature detected by said temperature detector that is less than (by a preset margin) a desired water temperature input to said electronic controller by a user by;

c). when a remote control is actuated and the temperature detected by said temperature detector that is less than (by a preset margin) a desired water temperature input to said electronic controller by a user by;

upon satisfaction of one of said conditions, said electronic controller configured to send a current to said first spark plug and causing gradual opening of said electrovalve to supply gas to said burner to ignite said burner with said first spark plug;

said electronic controller configured to generate a visual display of normal operation, or to close said electrovalve and terminate operation of said water heater if the change of current is not detected upon ignition within a defined time and to generate a visual display of equipment error.

2. The water heater as in claim 1, wherein said electronic controller is configured to cease operation of said burner upon said respective condition no longer being satisfied.

3. The water heater as in claim 1, wherein said electronic controller activates said electrovalve to supply gas to said burner no sooner than 1.5 seconds after causing said first spark plug to spark.

4. The water heater as in claim 3, wherein said electronic controller closes said electrovalve and terminates operation of said water heater if the change of current is not detected within 5.0 seconds of opening said electrovalve, said electronic card configured to wait a defined time until making at least one additional attempt to start said water heater, and displaying the visual indication of equipment error upon failure of the additional attempt.

5. The water heater as in claim 1, wherein power to said electronic controller is supplied by any combination of replaceable batteries, rechargeable batteries, or direct connection to an AC electrical grid.

6. The water heater as in claim 1, wherein said water heater comprises an 85% to 90% thermal heat transfer efficiency.

* * * * *